US006777151B2

(12) United States Patent
Hagi et al.

(10) Patent No.: US 6,777,151 B2
(45) Date of Patent: Aug. 17, 2004

(54) NEGATIVELY CHARGEABLE TONER AND IMAGE-FORMING METHOD

(75) Inventors: Masayuki Hagi, Mino (JP); Junichi Tamaoki, Sakai (JP); Megumi Aoki, Itami (JP); Hiroaki Kato, Itami (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 10/334,221

(22) Filed: Dec. 31, 2002

(65) Prior Publication Data

US 2003/0129510 A1 Jul. 10, 2003

(30) Foreign Application Priority Data

Jan. 9, 2002 (JP) ..... 2002-002207

(51) Int. Cl.[7] ..... G03G 9/08
(52) U.S. Cl. ..... 430/108.4; 430/108.6; 430/45
(58) Field of Search ..... 430/108.4, 108.6, 430/108.7, 45

(56) References Cited

U.S. PATENT DOCUMENTS 5,853,938 A 12/1998 Nakazawa et al.
6,117,607 A 9/2000 Shimizu et al.
6,194,116 B1 2/2001 Nishihara et al.
6,287,739 B1 9/2001 Kawakami et al.
6,312,862 B1 11/2001 Okado et al.
6,335,135 B1 * 1/2002 Arai et al. ..... 430/108.6
6,335,138 B1 * 1/2002 Kurose et al. ..... 430/110.2
6,338,929 B1 * 1/2002 Hagi et al. ..... 430/108.4

* cited by examiner

*Primary Examiner*—John L Goodrow
(74) *Attorney, Agent, or Firm*—Burns, Doane, Swecker & Mathis, L.L.P.

(57) ABSTRACT

The present invention relates to a negatively chargeable toner, comprising:

toner particles prepared by means of a wet granulation method; and external additives externally added to the toner particles, wherein the external additives comprises a first hydrophobic silica having a mean primary particle size of 5 nm to 18 nm, a second hydrophobic silica having a mean primary particle size of 18 nm to 50 nm, which is greater than that of the first hydrophobic silica, and a hydrophobic titanium oxide having a mean primary particle size of 10 nm to 40 nm, and a full color image-forming method using the negatively chargeable toner.

20 Claims, 1 Drawing Sheet

NEGATIVELY CHARGEABLE TONER AND IMAGE-FORMING METHOD

This application is based on an application No. 2002-002207 filed in Japan, the contents of which are hereby incorporated by reference.

BACKGROUND OF THE INVENTION

1. Field of the Invention

The present invention relates to a negatively chargeable toner used in an image-forming apparatus such as a copy machine, a printer, a facsimile or the like, and to an image-forming method using such a toner.

2. Description of the Related Art

Toner utilized in image-forming apparatuses using electrophotography or the like has conventionally been manufactured according to a kneading and pulverizing method wherein materials such as a binder resin, a coloring agent, a charge controlling agent, if necessary, an offset prevention agent are melted and kneaded, and the resultant mixture is pulverized and classified.

In recent years the demand for image-forming apparatuses that can produce higher quality images has increased and a toner having small particle size and having a sharp particle-size-distribution, which enable higher image quality, has come to be required. In addition, in an image-forming apparatus for forming a full color image using toners of a plurality of colors, a fixing member such as a heat roller and a pressure roller is applied with or impregnated with fixing oil such as silicone oil. Thereby, an offset phenomenon is prevented and the property of release of recording paper from the fixing member is secured. However, the demand for miniaturization and for cost reduction of full color image-forming apparatuses has increased and an oilless fixing apparatus wherein a fixing oil application mechanism etc. is not necessary has been adopted.

In the case of the manufacture of a toner according to the conventional kneading and pulverizing method, there is a problem wherein manufacturing costs increase as the particle size of the toner becomes smaller and as the distribution of particle size becomes sharper. In addition, though it is necessary to include an offset prevention agent in the toner in order to be applied to oilless fixing, waxes conventionally utilized as offset prevention agents, such as polyethylene wax, polypropylene wax, paraffin wax, carnauba wax and ester wax, are not compatible with a binder resin. There is a problem wherein it is difficult to add a large amount of an offset prevention agent to the toner because the offset prevention agent is isolated at the time of pulverization when a toner is manufactured according to the kneading and pulverizing method.

On the other hand, a manufacturing method for toner using a wet granulation method, such as a suspension polymerization method, a dispersion polymerization method, a resin particle association method or an emulsification dispersion method, has been focused on as a manufacturing method that can provide, at a low cost, a toner with a small particle size and a sharp distribution of particle size. Such wet granulation methods do not require a pulverizing process, such as the kneading and pulverizing method, They have such an advantage that a large amount of offset prevention agent can be added to the toner so as to be applied to oilless fixing.

However, in the case that a toner is manufactured according to a wet granulation method, granulation is, in general, carried out in an aqueous medium and a variety of agents, such as a surfactant, a dispersion stabilization agent and a salting agent are utilized. Though the above described variety of agents and water are removed from the toner through cleansing and drying during the manufacturing process for the toner, it is difficult to completely remove them and, due to the effects of these residual components, there is a problem wherein a toner gained according to a wet granulation method (hereinafter referred to as wet granulated toner) is low in chargeability and has an inferior charge stability in regard to environmental change in comparison with a toner gained according to the kneading and pulverizing method (hereinafter referred to as pulverized toner).

In more particular, when a wet granulated toner and a carrier are mixed and stirred for a long period of time, a problem arises wherein the amount of charge given to the toner is reduced in comparison with the initial condition of the toner. When image formation is repeatedly made, a problem arises wherein scattering of toner and image fogging increase.

In addition, in the case that a toner image formed on a photosensitive member, which is a electrostatic latent image-support member, is transferred to a medium to be transferred using a transfer roller, pressure is applied to the toner image on the photosensitive member by means of the transfer roller. There is a problem of the partial adhesion between the toner image and the photosensitive member, resulting in that the toner is prevented from shifting to the medium to be transferred to form image lacking (hollow defects). In general, though a wet granulated toner is uniform in form and has a smooth surface in comparison with a pulverized toner, adhesion of the toner to the photosensitive member is strong so that the problem of hollow defects at the time of transfer becomes significant. In particular, in a full color image-forming apparatus wherein an intermediate transfer member is adopted, a full color image is formed through primary transfer wherein a toner image formed on a photosensitive member, which is an electrostatic latent image-support member, is transferred to a intermediate transfer member using a transfer roller, and through secondary transfer wherein a full color toner image, formed of toner images of the respective colors overlapped on the intermediate transfer member, is transferred to recording paper using a transfer roller. In such a full color image-forming apparatus, as the primary transfer of a toner image on a photosensitive member, as well as secondary transfer of a full color toner image on a intermediate transfer member, is carried, it is further necessary to solve the problem of hollow defects.

A charge control agent (CCA) is added to the toner in order to control chargeability of toner and many CCAs excellent in chargeability include a metal, such as chrome, zinc or cobalt, and are expensive. A CCA-free toner, which does not include a CCA, is desired from the point of view of environmental protection as well as reduction in cost of the toner. However, as a wet granulated toner is low in chargeability in comparison with a pulverized toner as described above, it is difficult to produce a toner containing no CCA.

SUMMARY OF THE INVENTION

The present invention is to provide a negatively chargeable toner having excellent chargeablity and stability of chargeability even under environmental change by means of a wet granulation method.

Another purpose of the present invention is to provide a negatively chargeable toner having no problem of hollow defects in copied images at the time of pressure transfer without affecting adversely the chargeability.

Still another purpose of the present invention is to provide a negatively chargeable toner excellent in chargeability even in the absence of a CCA.

The present invention relates to a negatively chargeable toner, comprising:

toner particles prepared by means of a wet granulation method; and external additives externally added to the toner particles, wherein the external additives comprises a first hydrophobic silica having a mean primary particle size of 5 nm to 18 nm, a second hydrophobic silica having a mean primary particle size of 18 nm to 50 nm, which is greater than that of the first hydrophobic silica, and a hydrophobic titanium oxide having a mean primary particle size of 10 nm to 40 nm, and a full color image-forming method using the negatively chargeable toner.

DETAILED DESCRIPTION OF THE INVENTION

Figure 1:
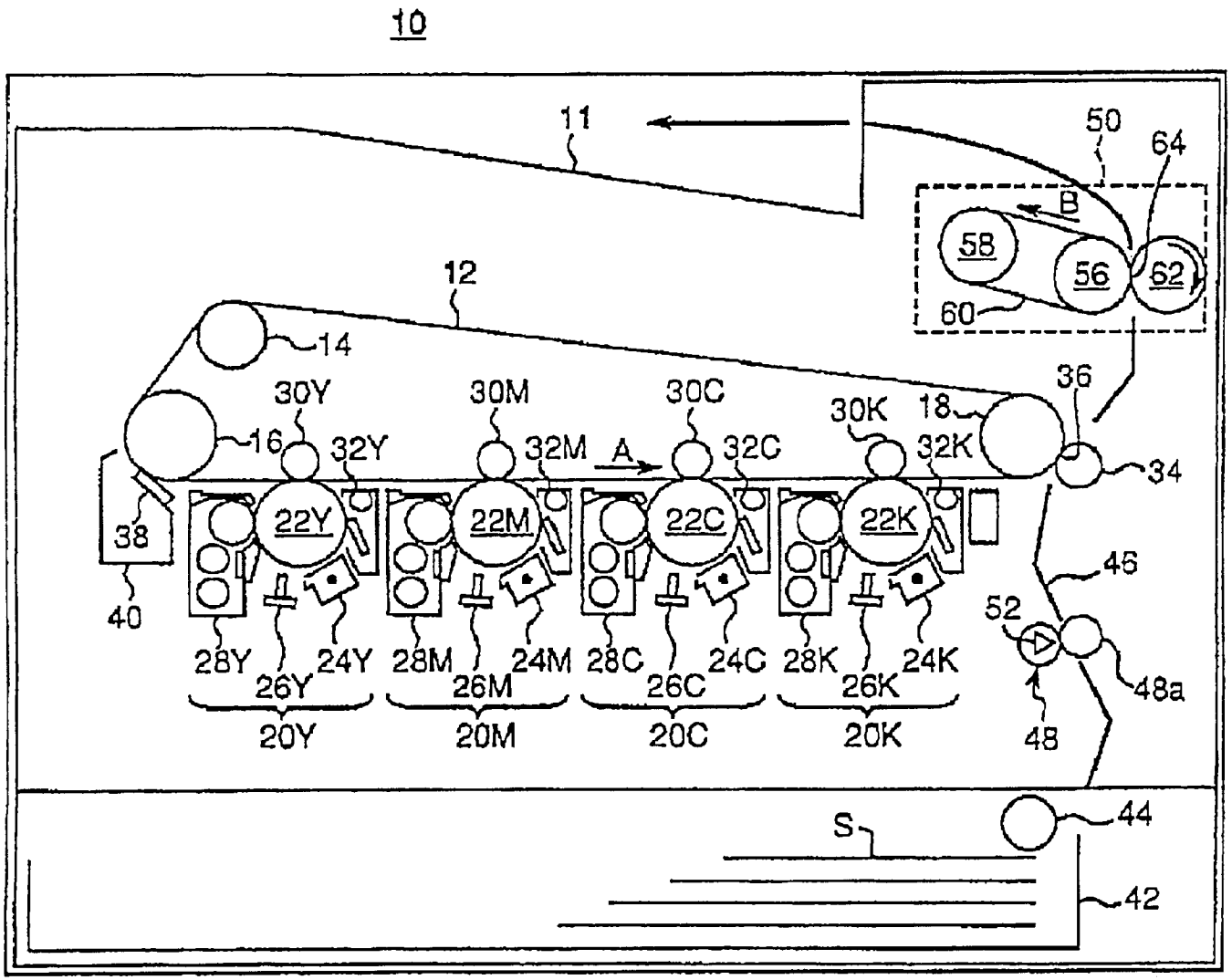
FIG. 1 is an overall configuration diagram showing an example of a full color image-forming apparatus that uses a negatively chargeable toner according to the present invention.

The present invention relates to a negatively chargeable toner, comprising:

toner particles prepared by means of a wet granulation method; and external additives externally added to the toner particles, wherein the external additives comprises a first hydrophobic silica having a mean primary particle size of 5 nm to 18 nm, a second hydrophobic silica having a mean primary particle size of 18 nm to 50 nm, which is greater than that of the first hydrophobic silica, and a hydrophobic titanium oxide having a mean primary particle size of 10 nm to 40 nm.

The present invention relates to an image-forming method for forming a full color image using the above described negatively chargeable toner.

A toner of the present invention comprises toner particles gained by means of a wet granulation method and external additives which are externally added to the toner particles. In the present specification "external additive" means fine particles added to a toner so as to exist outside of (on the surfaces of) the toner particles gained in advance by means of a wet granulation method.

As for the toner particles, toner particles that are manufactured by means of a wet granulation method, such as a suspension. polymerization method, a dispersion polymerization method, a resin particle association method or an emulsification dispersion method are used By manufacturing toner particles by means of such a method, it becomes possible to provide toner particles having a small particle size and having a sharp distribution of particle size in comparison with a pulverizing method. A suspension polymerization method and a resin particle association method are preferable among the wet granulation method. A resin particle association method is preferable from the point of view of freedom of control of toner particle form.

A resin particle association method is a method for manufacturing toner particles by means of coagulation (salting out) of particles in a particle dispersion liquid in which particles, including at least resin particles, are dispersed, and by heating and fusing the particles gained by coagulation. A method for coagulation from a mixture mixed at the time of coagulation with dispersions such as a coloring agent, which is a toner component, an offset prevention agent, if necessary, and a charge control agent, or a method for emulsion polymerization after dispersion of toner components, such as a coloring agent and an offset prevention agent, in a monomer forming resin particles can be cited. Preferably, resin particles, coloring agent particles and offset prevention agent particles are coagulated in an aqueous medium and then fused. It is preferable to utilize resin particles having a mean particle size of 50 nm to 1000 nm. Therefore, it is preferable to prepare resin particles by means of an emulsion polymerization method that can give fine particles.

With respect to coagulation (salting out) and fusion of particles including at least resin particles, fusion may be carried out after formation of coagulated primary particles or fusion may be carried out simultaneously with coagulation (salting out). In the latter case, a salting agent containing an alkali metal salt or an alkali earth metal salt is added to water wherein at least resin particles, coloring agent particles and offset prevention agent particles, for example, are dispersed at a critical coagulation concentration or higher and then heat is applied so that the temperature becomes no less than glass transition point of resin particles. Thereby, coagulation progresses, while fusion is carried out. At this time, a technique may be utilized wherein an organic solvent that is infinitely soluble in water is added so as to substantially lower the temperature of the glass transition point of the resin particles. Thereby, fusion is effectively carried out.

Metal atoms such as lithium, potassium, and sodium are cited as alkali metal atoms while metal atoms such as magnesium, calcium, strontium, and barium are cited as alkali earth metal atoms of an alkali metal salt or an alkali earth metal salt, which are salting agents. In particular, metal atoms such as potassium, sodium, magnesium, calcium, and barium are preferable. As for the form of salt of an alkali metal salt and an alkali earth metal salt, chloride, bromide, iodide, carbonate, and sulfate are cited.

As for an organic solvent that is infinitely soluble in water, methanol, ethanol, 1-propanol, 2-propanol, ethylene glycol, glycerin, acetone, for example, are cited. Alcohols that have three or fewer carbon atoms, such as methanol, ethanol, 1-propanol or 2-propanol are preferable and 2-propanol is more preferable.

As for the temperature at the time that the salting agent is added, a temperature that is no higher than the temperature of the glass transition point of resin particles is necessary. This is because in the case that the temperature at the time of addition of the salting agent is at or higher than the temperature of the glass transition point, though the salting out/fusion of resin particles progresses at a high rate, it becomes difficult to control particle size and a problem arises wherein particles having a large particle size are generated. As for the range of this temperature when the salting agent is added, though a temperature that is at or below the glass transition temperature of the resin particles is acceptable, it is, in general, between 5° C. and 55° C., preferably between 10° C. and 45° C. A method is preferable wherein the salting agent is added at a temperature that is at or below the glass transition temperature of the resin particles and then the temperature increases as quickly as possible, and heat is applied so that the temperature becomes higher than the glass transition temperature of the resin particles.

It is preferable for the resin particles to be prepared by emulsion polymerization. As for the monomers to be polymerized for preparation of these resin particles, the essential components thereof are monomers that undergo radical polymerization and a crosslinking agent can be utilized if necessary. In addition, the following monomers having an acidic group that undergo radical polymerization or monomers having a basic group that undergo radical polymerization may be included.

The monomers that undergo radical polymerization are not particularly limited. Conventionally known monomers that undergo radical polymerization can be used. For example, aromatic vinyl monomers, (meth) acrylic ester monomers, vinyl ester monomers, vinyl ether monomers, monoolefine monomers, diolefin monomers, halogenated olefin monomers etc. can be used.

Aromatic vinyl monomers are exemplified by styrene monomers such as styrene, o-methyl styrene, m-methyl styrene, p-methyl styrene, p-methoxy styrene, p-phenyl styrene, p-chlorostyrene, p-ethyl styrene, p-n-butyl styrene, p-tert-butyl styrene, p-n-hexyl styrene, p-n-octyl styrene, p-n-nonyl styrene, p-n-decyl styrene, p-n-dodecyl styrene, 2,4-dimethyl styrene, 3,4-dichlorostyrene and derivatives thereof.

(Meth) acrylic ester-based monomers are exemplified by acrylic acid, methacrylic acid, methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxy acrylate, propyl γ-aminoacrylate, stearyl methacrylate, dimethylaminoethyl methacrylate, diethylaminoethyl methacrylate, and the like.

Vinyl ester monomers are exemplified by vinyl acetate, vinyl propionate, vinyl benzoate, and the like. Vinyl ether monomers exemplified by vinyl methyl ether, vinyl ethyl ether, vinyl isobutyl ether, vinyl phenyl ether. Monoolefin-based monomers are exemplified by ethylene, propylene, isobutylene, 1-butene, 1-pentene, 4-methyl-1-pentene. Diolefin monomers are exemplified by butadiene, isoprene, chloroprene. Halogenated olefin monomers are exemplified by vinyl chloride, vinylidene chloride, vinyl bromide.

A crosslinking agent for radical polymerization may be utilized in order to improve the characteristics of the resin particles. Crosslinking agents for radical polymerization are exemplified by a crosslinking agent having two or more unsaturated bonds such as divinyl benzene, divinyl naphthalene, divinyl ether, diethylene glycol methacrylate, ethylene glycol dimethacrylate, polyethylene glycol dimethacrylate, diaryl phthalate. It is preferable to utilize the crosslinking agent for radical polymerization in a range of 0.1 to 10 parts by weight relative to 100 parts by weight of the total monomers that undergo radical polymerization.

As for monomers for radical polymerization having an acidic group, for example, monomers including a carboxyl group or a sulfone group can be used.

Monomers including a carboxyl acid group are exemplified by acrylic acid, methacrylic acid, fumaric acid, maleic acid, itaconic acid, cinnamic acid, monobutyl ester maleate and monooctyl ester maleate. Monomers including sulfonic acid are exemplified by styrene sulfonate, aryl sulfosuccinic acid and octyl aryl sulfosuccinate. These may have structures of alkaline metal salt such as of sodium or potassium or may have structures of alkaline earth metal salt such as of calcium.

As for radical polymerization monomers having a basic group, for example, amine compounds such as primary amine, secondary amine, tertiary amine and quaternary ammonium salt can be used.

Amine compounds are exemplified by dimethylaminoethyl acrylate, dimethylaminoethyl methacrylate, diethylaminoethyl acrylate, diethylaminoethyl methacrylate, quaternary ammonium salts of the above described four compounds, 3-dimethylaminophenyl acrylate, 2-hydroxy-3-methacryl oxypropyl trimethyl ammonium salt, acrylamide, N-butyl acrylamide, N,N-dibutyl acrylamide, piperidyl acrylamide, methacrylamide, N-butyl methacrylamide, N-octadecyl acrylamide, vinyl pyridine, vinyl pyrrolidone, vinyl N-methyl pyridinium chloride, vinyl N-ethyl pyridinium chloride, N,N-diaryl methyl ammonium chloride and N,N-diaryl ethyl ammonium chloride.

A radical polymerization initiator used in emulsion polymerization can be utilized properly as long as it is water soluble. For example, persulfates such as potassium persulfate and ammonium persulfate, azo compounds such as 4,4'-azobis 4-cyano valerate, the salt thereof and 2,2'-azobis (2-amidinopropane) salt, and peroxide compound etc. are cited. It is possible to use the above described radical polymerization initiator in the form of a redox initiator by combining it with a reducing agent if necessary. When a redox initiator is utilized, polymerization activation is increased, lowering of the polymerization temperature can be achieved, and shortening of polymerization time period can be expected.

As for the polymerization temperature, any temperature may be selected as long as it is the minimum radical generation temperature or higher of the polymerization initiator and the range between 50° C. and 90° C. is preferable. It is possible to carry out polymerization at room temperature or higher in combination of a polymerization initiators for initiation at room temperature, such as hydrogen peroxide-a reducing agent (such as ascorbic acid).

It is preferable to utilize a surfactant for emulsion polymerization of the above described monomers that undergo radical polymerization. The surfactant that can be utilized is not particularly limited and the following anionic or nonionic surfactants can be cited as preferable examples.

Anionic surfactants are exemplified by sodium dodecyl benzene sulfonate, sodium aryl alkyl polyether sulfonate, and the like, which are sulfonic acid salts, and sodium dodecyl sulfate, sodium tetradecyl sulfate, sodium pentadecyl sulfate, sodium octyl sulfate, and the like, which are sulfate salts, as well as sodium oleate, sodium laurate, sodium caprate, sodium caprylate, sodium caproate, potassium stearate, calsium oleate, which are fatty acid salts.

Nonionic surfactants are exemplified by polyethylene oxide, polypropylene oxide, a combination of polyethylene oxide and polypropylene oxide, alkyl phenol polyethylene oxide, an ester of a higher fatty acid and polyethylene glycol, an ester of a higher fatty acid and polypropylene oxide, sorbitan ester, and the like.

It is preferable to use an inorganic pigment or an organic pigment as a coloring agent. As for an inorganic pigment, a conventionally known black pigment or magnetic pigment can be cited. As for a black pigment, for example, carbon blacks, such as furnace black, channel black, acetylene black, thermal black, lamp black, and magnetic pigment such as magnetite and ferrite can be used. It is possible to use these inorganic pigments alone or in a combination as desired. It is preferable that addition amount of inorganic pigment is 2 to 20 parts by weight, preferably 3 to 15 parts by weight relative to the 100 parts by weight of toner particles. When the toner of the present invention is used as a magnetic toner, the above described magnetic pigment can be added. In the case of a magnetic toner, it is preferable to add a magnetic pigment of 20 to 60 parts by weight relative to the 100 parts by weight of toner particles from the point of view of addition of magnetic characteristics.

As for the organic pigment, conventional organic pigments can be used. Though any type of organic pigment can be utilized, organic pigments are concretely exemplified by the following.

Magenta or red pigments are exemplified by C. I. pigment red 2, C. I. pigment red 3, C. I. pigment red 5, C. I. pigment red 6, C. I. pigment red 7, C. I. pigment red 15, C. I. pigment red 16, C. I. pigment red 48:1, C. I. pigment red 53:1, C. I. pigment red 57:1, C. I. pigment red 122, C. I. pigment red 123, C. I. pigment red 139, C. I. pigment red 144, C. I. pigment red 149, C. I. pigment red 166, C. I. pigment red 177, C. I. pigment red 178, C. I. pigment red 222.

Orange or yellow pigments are exemplified by C. I. pigment orange 31, C. I. pigment orange 43, C. I. pigment yellow 12, C. I. pigment yellow 13, C. I. pigment yellow 14, C. I. pigment yellow 15, C. I. pigment yellow 17, C. I. pigment yellow 74, C. I. pigment yellow 93, C. I. pigment yellow 94, C. I. pigment yellow 138, C. I. pigment yellow 180.

Cyan or green pigments are exemplified by C. I. pigment blue 15, C. I. pigment blue 15:2, C. I. pigment blue 15:3, C. I. pigment blue 16, C. I. pigment blue 60, C. I. pigment green 7.

It is possible to use these organic pigments alone or in combination as desired. It is preferable that addition amount of the pigment is 2 to 20, preferably 3 to 15 parts by weight relative to the 100 parts of toner particles.

A surface modifying agent for a coloring agent can be utilized in order to modify the quality of the surface of the coloring agent. As for the surface modifying agent for a coloring agent, conventionally known agents can be utilized. Concretely, a silane coupling agent, a titanium coupling agent, an aluminum coupling agent etc. can be preferably used.

As for the offset prevention agent, for example, polyethylene wax, polyethylene wax that has been subjected to an oxidation-modified process (oxidized-type polyethylene wax), polypropylene wax, polypropylene wax that has been subjected to an oxidation-modified process (oxidized-type polypropylene wax), paraffin wax, microcrystalline wax, carnauba wax, fatty acid ester wax etc. are cited.

Particles of the offset prevention agent can be added by means of a variety of manners, such as a manner for adding the particles at the stage when the resin particles are emulsified and polymerized, a manner for simultaneously adding the particles and the resin particles in the coagulation (salting out) process, and a method for directly adding the particles to a prepared toner particles. As for preferable methods, a method for adding the offset prevention agent at the stage of emulsion polymerization of the above described resin particles, and a method for simultaneously adding the offset prevention agent and the resin particles in the above described coagulation (salting out) process so that the agent is included in the toner, can be cited.

Additives that can add a variety of functions may be added as toner components in addition to the above described coloring agent and offset prevention agent. Concretely, a charge control agent etc. is cited.

These additives can be added by means of a variety of manners, such as a manner for adding the additive at the stage when the resin particles are emulsified and polymerized, a manner for simultaneously adding the additive and the resin particles in the coagulation (salting out) process, and a manner for directly adding the additive to a prepared toner. As for preferable methods, a method for adding the additive at the stage of emulsion polymerization of the above described resin particles, and a method for simultaneously adding the additive and the resin particles in the above described coagulation (salting out) process so that the additive is included in the toner, can be cited.

As for the charge control agent utilized as an additive, it is preferable to utilize a conventionally known substance that can be dispersed in water. Concretely, naphthenic acid or a metal salt of a higher fatty acid, an azo-based metal complex, a metal salicylate, or metal complexes thereof are cited. It is preferable that the charge control agent has a mean primary particle size of approximately 10 nm to 500 nm in the dispersed condition.

In the present invention, a toner without a charge control agent is preferable from the point of view of environmental protection as well as from the point of view of reduction of cost of the toner.

Toner particles in an aqueous medium gained in the fusion process are filtered and washed in cleansing water so that impurities attached to the toner particles, such as surfactants or salting agents, are removed. The filter and the cleaning machine utilized in this process are not particularly limited, while a centrifugal separator, a Nutsche filter, a filter pressetc., for example, may beused.

The toner particles after filtration and washing are dried. The drier utilized in this process is not particularly limited, while a spray drier, a reduced pressure drier, a vacuum drier, a stationary shelf drier, a mobile shelf drier, a floating layer-type drier, a rotating drier, a stir-type drier, or the like, is used. It is preferable that an amount of water in 100 parts by weight of the toner particles after drying is 5 parts by weight or less, preferably 2 parts by weight or less.

A toner is prepared by externally adding an external additive to the toner particles gained by means of a wet granulation method as described above.

Such an external additive includes a first hydrophobic silica having a mean primary particle size of 5 nm to 18 nm, a second hydrophobic silica having a mean primary particle size of 18 nm to 50 nm, which is greater than that of the first hydrophobic silica and hydrophobic titanium oxide having a mean primary particle size of 10 nm to 40 nm. By externally adding three such specific external additives to the toner particles, it becomes possible to provide a negatively chargeable toner that has charge stability in regard to environmental change and that can solve the problem of hollow defects in images without reducing the chargeability in spite of the utilization of toner particles gained by means of a wet granulation method.

In the case that the first hydrophobic silica is replaced with hydrophobic titanium oxide, for example, having the same mean primary particle size as that of the first hydrophobic silica, a problem arises wherein the amount of charge is particularly reduced at the time of stirring. In the case that the second hydrophobic silica is replaced with hydrophobic titanium oxide having the same mean primary particle size as that of the second hydrophobic silica, a problem arises wherein the amount of charge is reduced in an environment of high temperature and high humidity, and a problem of durability arises resulting in toner particle smoke.

The mean primary particle size of the first hydrophobic silica is 5 nm to 18 nm, preferably 7 nm to 17 nm, more preferably 10 nm to 16 nm. Such first hydrophobic silica is externally added to toner particles, so that the desired fluidity is provided and the negative chargeability can be improved. In addition, the quality of an image, in particular the fineness of a half-tone image, can be enhanced. When the mean primary particle size of the first hydrophobic silica is less than 5 nm, the fluidity of the first hydrophobic silica, which is buried in toner particles due to the stirring stress of a developer, is significantly reduced. When the mean primary particle size of the first hydrophobic silica is greater than 18 nm, the effect of increase in fluidity and the effect of improvement of image quality are reduced. It is desirable that the hydrophobicized degree of the first hydrophobic silica is 50% or higher, preferably from 60% to 90%.

The addition amount of the first hydrophobic silica is 0.05 to 2 parts by weight relative to the 100 parts by weight of toner particles, preferably 0.08 to 1.2 parts by weight, more preferably 0.1 to 1 parts by weight. When the addition amount is less than 0.05 parts by weight, the toner cannot gain a sufficient fluidity or negative chargeability. In the case of being greater than 2 parts by weight, a problem of image noise (BS) on copied images arises together with adhesion of the first hydrophobic silica, which is released from the toner, to the surface of the photosensitive member, or problems of fogging, particle smoke and the like arise as the end of lifetime is approached as a result of contamination of the carrier in the case that the toner is used in a two-component developer.

The mean primary particle size of the second hydrophobic silica is 18 nm to 50 nm, preferably 20 nm to 40 nm, more preferably 20 nm to 35 nm. The second hydrophobic silica has a mean primary particle size greater than that of the first hydrophobic silica. It is preferable that the second hydrophobic silica has a mean primary particle size greater than that of the first hydrophobic silica by 3 nm or more, preferable by 4 nm or more. The transfer properties of the toner can be improved by externally adding such second hydrophobic silica to the toner particles and the problem of hollow defects can be solved even in the case that pressure transfer is carried out using, for example, a transfer roller. The negative chargeability of the toner can be improved. When the mean primary particle size of the second hydrophobic silica is smaller than 18 nm, the effects of improvement of the transfer properties are reduced. When the mean primary particle size of the second hydrophobic silica is greater than 50 nm, it becomes necessary to add a large amount of the second hydrophobic silica in order to gain the effects of transfer properties and toner particle smoke and image noise (BS) may more easily occur. It is desirable that a hydrophobicized degree of the second hydrophobic silica is 50% or higher, preferably from 60% to 90%.

The addition amount of the second hydrophobic silica is from 0.1 to 2 parts by weight, preferably from 0.2 to 1.5 parts by weight, more preferably from 0.3 to 1.0 parts by weight relative to 100 parts by weight of the toner particles. When the addition amount is smaller than 0.1 part by weight; the effects of addition of the second hydrophobic silica become insufficient. On the other hand, in the case of being greater than 2 parts by weight, a problem of image noise (BS) on copied images arises together with adhesion of the second hydrophobic silica, which is released from the toner, to the surface of the photosensitive member, or problems of fogging, particle smoke and the like arise as the end of lifetime is approached as a result of contamination of the carrier in the case that the toner is used in a two-component developer.

The mean primary particle size of the hydrophobic titanium oxide is 10 nm to 40 nm, preferably 15 nm to 35 nm, more preferably 15 nm to 30 nm. Toner stability in regard to environmental change can be improved by externally adding such hydrophobic titanium oxide to the toner particles together with the above described first and second hydrophobic silica. In particular, the problem of increase of charging amount of toner at the time of low temperature and low humidity can be solved without the occurrence of the problem of decrease of charging amount of toner at the time of high temperature and high humidity. In the case that the mean primary particle size of hydrophobic titanium oxide is greater than 40 nm, the problem of decrease of charging amount of toner occurs at the time of high temperature and high humidity even though the problem of increase of charging amount of toner at the time of low temperature and low humidity can be solved. It is desirable for the hydrophobicized degree of the hydrophobic titanium oxide is 50% or higher, preferably from 60% to 80%.

The addition amount of the above described hydrophobic titanium oxide is from 0.1 to 2 parts by weight, preferably from 0.2 to 1.5 parts by weight, more preferably from 0.3 to 1.0 parts by weight relative to 100 parts by weight. When the addition amount is smaller than 0.1 part by weight, the effects of addition of the hydrophobic titanium oxide become insufficient. On the other hand, in the case of being greater than 2 parts by weight, the charging amount may be reduced under an environment of high temperature and high humidity and a problem of image noise (BS) on copied images arises together with adhesion of the hydrophobic titanium oxide, which is released from the toner, to the surface of the photosensitive member, or problems of fogging, particle smoke or the like arise as the end of lifetime is approached as a result of contamination of the carrier in the case that the toner is used in a two-component developer.

In addition, conventionally known inorganic fine particles or organic fine particles may be added as an external additive in addition to the above described three specific external additives.

It is preferable to use inorganic particles having a mean particle size of 80 nm to 1200 nm, preferably 80 nm to 1000, more preferably 100 nm to 800 nm as such an external additive. By externally adding inorganic particles having such particle size, a stationary layer is formed of these inorganic particles in a gap between the photosensitive member and the cleaning blade so that the sneaking-through of the other external additive is prevented. In particular, image noise (BS) of copied images accompanied by adhesion of the first hydrophobic silica, the second hydrophobic silica or hydrophobic titanium oxide to the surface of the photosensitive member can be prevented and it becomes possible that the photosensitive member is properly polished.

It is preferable that the inorganic particles having the above described particle size have hardness sufficient to polish the surface of the photosensitive member. For example, silica, titanium oxide, alumina or titanium oxide compound, silicate compound and sintered compacts thereof are preferably used. It is more preferable that the inorganic particles having with the above described particle size have weak positive chargeability. When the inorganic particles have the weak positive chargeability, the spacer effects between the toner and carrier increase and carrier degradation, which occurs when the toner components are moving to the carrier, are reduced so that excellent electrification-build-up properties can be gained in the case that the negatively chargeable toner is used as a two-component developer. Strontium titanium oxide particles are preferably used as particles having sufficient hardness as described above and having weak positive chargeability. These organic particles may be used after being processed so as to have hydrophobicity with a conventionally known silane coupling agent, silicone oil, or the like. The addition amount of these inorganic particles is 0.4 to 3.5 parts by weight relative to the 100 parts by weight of toner particles, preferably 0.5 to 3.0 parts by weight, more preferably 1.0 to 3.0 parts by weight.

It is preferable to use fatty acid metal salt having a volume mean particle size of 1.5 μm to 12 μm, preferably 2 μm to 10 μm as an external additive. By externally adding such a fatty acid metal salt to the toner particles, coating film having lubricity is uniformly added to the surface of the photosensitive member so that adhesion of the toner component to this surface is prevented and the formation of BS can be prevented.

The fatty acid metal salt may be exemplified by a salt of fatty acid represented by the general formula of $C_nH_{2+1}$ COOH (n indicates 12 to 18 in the formula) and metal. The metal is not particularly limited as long as it can form salt with the above described fatty acid. Calcium, zinc, magnesium, aluminum, lithium and the like, for example, can be cited. Calcium is preferable from the point of view of reduction in cost, increased safety and prevention in reduction of elasticity (hardness) of silicone rubber in the full color process. Fatty acid metal salt having a melting point of from approximately 100° C. to 150° C. is preferable from the point of view of heat resistance and of lubricity. It is preferable to use, for example, calcium stearate, zinc stearate, magnesium stearate or the like. As for calcium stearate, the one manufactured by means of a direct method and the one manufactured by means of a double decomposition method are known. It is preferable to use the one prepared by means of the direct method producing lower amount of impurities after being pulverized and adjusted in particle size.

The addition amount of the fatty acid metal salt is from 0.02 to 0.25 parts by weight relative to the 100 weight part of toner particles, preferably from 0.02 to 0.2 parts by weight, preferably 0.02 to 0.1 parts by weight.

The toner of the present invention can be utilized either in a one component developer wherein a carrier is not utilized or in a two component developer utilized with a carrier. In addition, the toner of the present invention may be either a magnetic toner or a non-magnetic toner in the case of a black toner. It is preferable to utilize the toner of the present invention as a non-magnetic full color toner for a two component developer. The black toner for a full color toner may be either a magnetic toner or a non-magnetic toner.

It is desirable for the toner of the present invention to have a volume mean particle size of from 3 μm to 7 μm, preferably from 4 μm to 7 μm.

As for the carrier utilized with the toner of the present invention, a conventionally known carrier can be utilized and, for example, carriers made of magnetic particles, such as iron particles, ferrite, or the like, coated carriers wherein the surface of magnetic particles is covered with a coating agent of resin and a binder-type carrier wherein magnetic particles are dispersed in a binder resin can be utilized. As for such carriers, the one type having a volume mean particle size of from 20 μm to 60 μm, preferably from 25 μm to 50 μm is preferable.

A full color image-forming apparatus suitable for the toner of the present invention is a full color image-forming apparatus comprises:

forming a full color toner image, wherein the step of forming a toner image on an electrostatic latent image-support member and transferring this toner image from the electrostatic latent image-support member to an intermediate transfer member (for example, belt) by means of a primary transfer roller is sequentially carried out for each of the predetermined color so that toner images of the respective colors are overlapped on the intermediate transfer member (belt);

transferring said full color toner image on the intermediate transfer member (belt) from the intermediate transfer member (belt) to a recording medium by means of a secondary transfer roller at a portion where the intermediate transfer member (belt) is supported by a support roller; and fixing the transferred full color toner image on the recording medium. Such a full color image-forming apparatus is shown in FIG. 1.

FIG. 1 is the entire configuration diagram of a tandem-type digital color printer (hereinafter referred to as simply "printer") 10.

Printer 10 is provided with an intermediate transfer belt 12 in approximately the center portion of the inside thereof. The intermediate transfer belt 12 is supported by the external periphery portions of the three rollers, 14, 16 and 18, and is driven in a rotational manner in the direction of arrow A. The intermediate transfer belt 12 is made by dispersing conductive carbon particles in a resin, such as polycarbonate, polyimide, or the like, and has the properties of a semiconductor wherein the resistance value is approximately from $10^9$ Ω·cm to $10^{11}$ Ω·cm.

Four image formation units 20Y, 20M, 20C and 20K corresponding respectively to the respective colors of yellow (Y), magenta (M), cyan (C) and black (K) are arranged side-by-side along the intermediate transfer belt 12 beneath the lower horizontal portion of intermediate transfer belt 12.

The image formation units 20Y, 20M, 20C and 20K have photosensitive drums 22Y, 22M, 22C and 22K respectively.

A charging device 24Y for uniformly charging the surface of photosensitive drum 22Y, a print head 26Y for forming by carrying out exposure in accordance with image data an electrostatic latent image on the surface of photosensitive drum that is uniformly charged, a developing device 28Y for forming a toner image by developing the electrostatic latent image formed on the surface of photosensitive drum with a yellow toner, a primary transfer roller 30Y for transferring the toner image, which is formed on the surface of photosensitive drum, onto the intermediate transfer belt 12 by electrostatically attracting the toner image, being located opposite to the photosensitive drum 22Y with the intermediate transfer belt 12 placed in between, and a cleaner 32Y for retrieving the residual toner on the surface of photosensitive drum after the primary transfer and for cleaning the surface of photosensitive drum are sequentially arranged around the photosensitive drum 22Y in the direction of rotation thereof.

In the same manner, a charging device 24M, a print head 26M, a developing device 28M for developing an electrostatic latent image, which is formed on the surface of the photosensitive drum, with a magenta toner so as to give a toner image, a primary transfer roller 30M, and a cleaner 32M are arranged around the photosensitive drum 22M in the direction of rotation thereof. A charging device 24C, a print head 26C, a developing device 28C for developing an electrostatic latent image, which is formed on the surface of the photosensitive drum, with a cyan toner so as to give a toner image, a primary transfer roller 30C, and a cleaner 32C are arranged around photosensitive drum 22C. A charging device 24K, a print head 26K, a developing device 28K for developing an electrostatic latent image, which is formed on the surface of the photosensitive drum, with a black toner so as to gain a toner image, a primary transfer roller 30K, and a cleaner 32K are arranged around photosensitive drum 22K. Print heads 26Y, 26M, 26C and 26K are formed of a large number of LEDs aligned in the main scanning direction parallel to the axis direction of the photosensitive drums.

A secondary transfer roller 34 is pressed against a portion of the intermediate transfer belt 12 supported by a roller 18. The nip portion between the secondary transfer roller 34 and the intermediate transfer belt is a secondary transfer region 36. A transfer voltage is applied to the secondary transfer roller 34. The toner image formed on the intermediate transfer belt 12 is electrostatically attracted by means of this transfer voltage to a recording medium such as paper that is conveyed to the secondary transfer region as described below, so that a secondary transfer is carried out.

A cleaner 38 is pressed against the portion of the intermediate transfer belt 12 supported by roller 16. This cleaner 38 scrapes off residual toner on the intermediate transfer belt 12 after the secondary transfer to collect the toner into a toner deposit box 40.

A paper feed cassette 42 is arranged in the lower portion of printer 10 so as to be removable. Sheets of paper S contained in an overlapping manner within the paper feed cassette 42 is fed out, sheet by sheet, to a conveyance path 46 starting from the top sheet by means of the rotation of a paper feed roller 44.

The conveyance path 46 extends from the paper feed cassette 42, through a nip portion formed by a pair of timing rollers 48, the secondary transfer region 36 and a fixation unit 50 and to a paper delivery tray 11.

A paper feed sensor 52 is arranged in the vicinity of timing roller pair 48. The paper feed sensor 52 detects the edge of a sheet of paper S being pinched between the pair of timing rollers 48 that has been fed out from the paper feed cassette 42 to the conveyance path 46. When the edge of a sheet of paper S is detected by the paper feed sensor 52, the pair of timing rollers 48 stops its rotation once. Then, the sheet S of paper is fed out to the secondary transfer region 36 in synchronization with the toner image on the intermediate transfer belt 12.

The fixture unit 50 is provided with a fixture belt 60 supported by a pair of rollers 56 and 58 and is driven so as to rotate in the direction of arrow B and a fixture roller 62 which is pressed against roller 56 via this fixture belt 60 so as to rotate in the direction of the arrow in accordance with the rotation of roller 56. A fixture region 64 is provided as the nip portion between the fixture belt 60 and the fixture roller 62 between which a sheet of paper on which a toner image is secondarily transferred passes.

The operation of printer 10 having the above described configuration is described. When an image signal is inputted to an image signal processor (not shown) of printer 10 from an external apparatus (for example, a personal computer), the image signal processor produces a digital image signal by converting this image signal into color signals of yellow, cyan, magenta and black so that this digital image signal is conveyed to an LED drive circuit for the print head. This drive circuit carries out exposures by making print heads 26Y, 26M, 26C and 26K of the respective image formation units 20Y, 20M, 20C and 20K emit light based on the inputted digital signal. These exposure processes are carried out by print heads 26Y, 26M, 26C and 26K in this order with time gaps between the processes. Thereby, an electrostatic latent image for each color is formed on the surface of each of photosensitive drums 22Y, 22M, 22C and 22K.

The electrostatic latent image formed on each of photosensitive drums 22Y, 22M, 22C and 22K is developed by each of developers 28Y, 28M, 28C and 28K so as to become a toner image of each color. Then, the toner image of each color is sequentially is primarily transferred to be overlapped by means of the effects of each of primary transfer rollers 30Y, 30M, 30C and 30K so that a toner image is formed.

The overlapped toner image formed in the above described manner on the intermediate transfer belt 12 reaches to the secondary transfer region 36 in accordance with the shift of the intermediate transfer belt 12. The overlapped toner image is secondarily transferred onto a sheet of paper S supplied by the timing roller pair 48 after being fed out to conveyance path 46 from the paper feed cassette 42 by means of the effects of secondary transfer roller 34 in the above described secondary transfer region 36. The residual toner on the intermediate transfer belt 12 after secondary transfer is collected by the cleaner 38.

The sheet of paper S on which the toner image is secondarily transferred is sent to the fixture unit 50 through the conveyance path 46 wherein the sheet of paper passes through the fixture region 64 so that the toner image is fixed to the sheet of paper S. Then, the sheet of paper S is delivered to the paper delivery tray 11.

As respective image formation units 20Y, 20M, 20C and 20K are placed under the intermediate transfer belt, the distance between the primary transfer position and the secondary transfer position in image formation unit K can be made short. Therefore, the following advantages are gained: the rate of image formation on the first sheet of paper can be increased; the amount of toner wasted can be reduced through reduction of the number of toner images formed on the intermediate transfer belt at the time when the image formation operation is interrupted as a result of malfunctions such as jamming; and the distance between the secondary transfer position and the fixture apparatus can easily be made short so that the operation can cope with sheets of paper of small sizes, such as postcards.

Though the printer of FIG. 1 has a configuration wherein the respective image formation units are placed under the intermediate transfer belt, it may have a configuration wherein, for example, the respective image formation units are placed over the intermediate transfer belt.

The embodiments of the present invention are concretely described in the following.

EXAMPLES (Preparation of Solution with Fine Particles of Resin Dispersed)

A solution was prepared by mixing and solving 315 parts by weight of styrene, 85 parts by weight of n-butyl acrylate, 6 parts by weight of acrylic acid and 10 parts by weight of dodecane thiol. On the other hand, 6 parts by weight of nonionic surfactant (Nonipol 400: manufactured by Kao Corporation) and 10 parts by weight of anionic surfactant (Neogen SC: manufactured by Dai-ichi Kogyo Seiyaku Co., Ltd.) were solved in 550 parts by weight of ion exchanged water, into which the above described solution was added to be dispersed and emulsified in the flask. Then, 50 parts by weight of ion exchanged water, in which 4 parts by weight of ammonium persulfate was solved, was added while the resultant solution was slowly mixed and stirred for 10 minutes. After the atmosphere in the system was sufficiently replaced with nitrogen, the flask was heated up to 70° C. in an oil bath while being stirred and emulsion polymerization was continued for five hours under these conditions, so that a solution was gained wherein fine particles of anionic resin having a particle size of 171 nm, a glass transition point of 54° C., and Mw of 34300, were dispersed.

(Preparation of Liquid wherein Coloring Agent is Dispersed)

Fifty parts by weight of C.I. pigment blue 15-3 (cyan pigment), 5 parts by weight of nonionic surfactant (Nonipol 400: manufactured by Kao Corporation) and ion exchanged water were dispersed for 10 minutes by means of Homogenizer (Ultra-Turrax: manufactured by IKA-Works Inc.) so that a solution containing cyan pigment particles was prepared wherein cyan coloring agent was dispersed.

In addition, a solution wherein a yellow coloring agent was dispersed was prepared in the same manner except that the above described C.I. pigment blue 15-3 (cyan pigment) was replaced with C.I. pigment yellow 74, a solution wherein a magenta coloring agent was dispersed was prepared in the same manner except that the above described C.I. pigment blue 15-3 (cyan pigment) was replaced with C.I. pigment red 122 and a solution wherein a black coloring agent was dispersed was prepared in the same manner except that the above described C.I. pigment blue 15-3 (cyan pigment) was replaced with carbon black (Regal 330R: manufactured by Cabot Corporation), respectively.

(Preparation of Solution wherein Offset Prevention Agent is Dispersed)

Fifty parts by weight of paraffin wax (HNP0190: manufactured by Nippon Seiro Corporation), 5 parts by weight of cationic surfactant (Sanisol B50: manufactured by Kao. Corporation) and 200 parts by weight of ion exchange water were heated up to 95° C. and were sufficiently dispersed in Homogenizer (Ultra-Turrax. T50: manufactured by IKA-Works Inc.). Then, a dispersion process is carried out in a pressure discharging-type homogenizer to give a solution with an offset prevention agent dispersed, in which mold release agent particles having a particle size of 180 nm were contained.

(Preparation of Cyan Toner Particles)

Two hundred parts by weight of the liquid solution with fine particles of resin dispersed, 40 parts by weight of the solution wherein cyan coloring agent was dispersed, 50 parts by weight of the liquid solution wherein an offset prevention agent was dispersed and 1.23 parts by weight of poly (aluminum chloride) were sufficiently mixed and dispersed by means of Homogenizer (Ultra-Turrax T50: manufactured by IKA-Works Inc.) in a round flask made of stainless steel. Then, the flask was heated up in an oil bath for heating while being stirred up to coagulation temperature of 52° C. The temperature of 52° C. was maintained for 60 minutes and, then, 60 parts by weight of the liquid solution with fine particles of resin dispersed was added to the flask, and gently stirred.

Then, the pH within the system was adjusted to 6.0 using a sodium hydroxide solution of 0.5 mol/L and, then, the flask made of stainless steel was tightly closed and heated up to 97° C. while stirring was continued by means of magnetic force sealing. After that, the pH within the system is adjusted to 4.0, which is maintained for six hours. After completion of the reaction, the system was cooled down, filtered and sufficiently washed with ion exchanged water and, then, separation of solid and liquid was carried out by means of Nutsche-type suction filtering. Furthermore, the system was again dispersed in 3 L of ion exchanged water at 40° C., was stirred for 15 minutes at 300 rpm and was washed. After this washing operation was repeated five times, separation of solid and liquid was carried out by means of Nutsche-type suction filtering. Then, vacuum drying was continued for 12 hours so as to give cyan toner particles having a volume mean particle size of 6 μm.

(Preparation of Yellow Toner Particles)

Yellow toner particles having a volume mean particle size of 6 μm were prepared in the same manner as in the preparation of cyan toner particles except that the solution with cyan coloring agent dispersed was replaced with the liquid solution with yellow coloring agent dispersed.

(Preparation of Magenta Toner Particles)

Magenta toner particles having a volume mean particle size of 6 μm was prepared in the same manner as in the preparation of cyan toner particles except that the solution with cyan coloring agent dispersed was replaced with the liquid with magenta coloring agent was dispersed.

(Preparation of Black Toner Particles)

Black toner particles having a volume mean particle size of 6 μm were prepared in the same manner as in the preparation of cyan toner particles except that the solution with cyan coloring agent dispersed was replaced with a solution with black coloring agent dispersed.

The amount shown in Table 1 of each of the external additives shown in Table 1 was added to 100 parts by weight of each of the above described toner particles and was mixed using Henschel mixer so as to give a toner.

TABLE 1

| | External additives | | | | | | | | | |
|---|---|---|---|---|---|---|---|---|---|---|
| | Types | Amount added (parts by weight) | Types | Amount added (parts by weight) | Types | Amount added (parts by weight) | Types | Amount added (parts by weight) | Types | Amount added (parts by weight) |
| Example 1 | S1 | 0.2 | S3 | 0.4 | T1 | 0.5 | SrT | 2.0 | CaST | 0.05 |
| Example 2 | S1 | 0.5 | S3 | 0.4 | T1 | 0.5 | SrT | 2.0 | CaST | 0.05 |
| Example 3 | S1 | 0.2 | S3 | 0.8 | T1 | 0.5 | SrT | 2.0 | CaST | 0.05 |
| Example 4 | S1 | 0.2 | S3 | 0.3 | T1 | 0.8 | SrT | 2.0 | CaST | 0.05 |
| Example 5 | S1 | 0.2 | S3 | 0.3 | T1 | 0.5 | SrT | 2.5 | CaST | 0.05 |
| Example 6 | S1 | 0.2 | S3 | 0.3 | T1 | 0.5 | SrT | 2.0 | CaST | 0.1 |
| Example 7 | S2 | 0.2 | S3 | 0.3 | T1 | 0.5 | SrT | 2.0 | CaST | 0.05 |
| Example 8 | S1 | 0.2 | S3 | 0.3 | T2 | 0.5 | SrT | 2.0 | CaST | 0.05 |
| Comparative example 1 | — | — | S3 | 0.4 | T1 | 0.5 | SrT | 2.0 | CaST | 0.05 |
| Comparative example 2 | S1 | 0.2 | — | — | T1 | 0.5 | SrT | 2.0 | CaST | 0.05 |
| Comparative example 3 | S1 | 0.2 | S3 | 0.4 | — | — | SrT | 2.0 | CaST | 0.05 |
| Comparative example 4 | S1 | 0.2 | T3 | 0.4 | T1 | 0.5 | SrT | 2.0 | CaST | 0.05 |
| Comparative example 5 | S1 | 0.2 | S3 | 0.4 | T3 | 0.5 | SrT | 2.0 | CaST | 0.05 |
| Comparative example 6 | S1 | 0.2 | S3 | 0.4 | T3 | 0.5 | — | — | CaST | 0.05 |
| Comparative example 7 | S1 | 0.2 | S3 | 0.4 | T3 | 0.5 | SrT | 2.0 | — | — |
| Comparative example 8 | T1 | 0.2 | S3 | 0.4 | T1 | 0.5 | SrT | 2.0 | CaST | 0.05 |

TABLE 1-continued

| | External additives | | | | | | | | | |
|---|---|---|---|---|---|---|---|---|---|---|
| | Types | Amount added (parts by weight) | Types | Amount added (parts by weight) | Types | Amount added (parts by weight) | Types | Amount added (parts by weight) | Types | Amount added (parts by weight) |
| Comparative example 9 | S1 | 0.2 | T1 | 0.4 | T1 | 0.5 | SrT | 2.0 | CaST | 0.05 |
| Comparative example 10 | S1 | 0.2 | T2 | 0.4 | T1 | 0.5 | SrT | 2.0 | CaST | 0.05 |
| Comparative example 11 | S2 | 0.2 | S1 | 0.4 | T1 | 0.5 | SrT | 2.0 | CaST | 0.05 |

In Table 1, S1 means a hydrophobic silica having a hydrophobicity of 80%, prepared by by carrying out a surface process on silica (#130: manufactured by Nippon Aerosil Co., Ltd.) having a mean primary particle size of 16 nm, with hexa-methyl disilazane (HMDS), which is hydrophobizing agent;

S2 means a hydrophobic silica having a hydrophobicity of 82%, prepared by carrying out a surface process on silica, (#200: manufactured by Nippon Aerosil Co., Ltd.) having a mean primary particle size of 12 nm, with HMDS; S3 means a hydrophobic silica having a hydrophobicity of 88%, prepared by carrying out a surface process on silica, (#9OG: manufactured by Nippon Aerosil Co., Ltd.) having a mean primary particle size of 20 nm, with HMDS;

T1 means a hydrophobic titanium oxide having a hydrophobicity of 62%, prepared by carrying out a surface process on anatase-type titanium oxide having a mean primary particle size of 20 nm, in water with isobutyl trimethoxysilane, which is hydrophobizing agent;.

T2 means a hydrophobic titanium oxide having a hydrophobicity of 65%, prepared by carrying out a surface process on anatase-type titanium oxide, having a mean primary particle size of 30 nm, in water with isobutyl trimethoxysilane;

T3 means a hydrophobic titanium oxide having a hydrophobicity of 62%, prepared by carrying out a surface process on anatase-type titanium oxide, having a mean primary particle size of 50 nm, in water with isobutyl trimethoxysilane;

Srt means strontium titanium oxide having a mean particle size of 350 nm; and

Cast means calcium stearate having a volume mean particle size of 4 μm, respectively.

(Evaluation of Change in Electrical Charge as a Result of Mixing)

A two component developer was prepared by mixing a cyan toner in which the above described cyan toner particles were added with the external additives of the respective embodiments and Comparative examples, with a genuine carrier for a digital color copying machine CF2001 (manufactured by Minolta Co., Ltd), so that the weight of the toner became 8 wt. %. Ten grams of this developer was put in a 20 cc polyethylene bottle and the polyethylene bottle was rotated at 120 rpm by means of a roll mill so that the developer was stirred. An charged amount of the toner was measured by an electrical field separation-type charge amount measurement method (Qb method) in regard to the initial developer (after stirring for five minutes) and in regard to the developer after it was stirred for a long period of time (600 minutes). Evaluation was ranked by marking ⊚ for the result wherein the amount of drop in the charge amount after stirring for a long period of time relative to the initial charge amount was less than 10 μC/g, by marking O for the result wherein the amount of drop in the charge amount after stirring for a long period of time relative to the initial charge amount was no less than 10 μC/g and less than 20 μC/g, by marking Δ for the result wherein the amount of drop in the charge amount after stirring for a long period of time relative to the initial charge amount was no less than 20 μC/g and less than 30 μC/g and by marking x for the result wherein the amount of drop in the charge amount after stirring for a long period of time relative to the initial charge amount is no less than 30 μC/g. The results are shown in Table 2.

(Evaluation of Environmental Stability)

A two component developer was prepared in the same manner as in the above described "Evaluation of Change in Charge as a Result of Mixing" section. This developer of 10 g was put into a 20 cc polyethylene bottle and the polyethylene bottle was rotated at 120 rpm for 100 minutes by means of a roll mill so that the developer was stirred and, after that, an amount of charge of the toner was measured under a high temperature high humidity (30° C./85%) environment (HH environment) and under a low temperature low humidity (10° C./15%) environment (LL environment) in accordance with a film development-type charge amount measurement method (Qf method). The amount of the charge under the HH environment was evaluated to be ranked by marking ⊚ for the result wherein the amount of charge was no less than 25 μC/g, by marking O for the result wherein the amount of charge was no less than 20 μC/g and less than 25 μC/g, by marking Δ for the result wherein the amount of charge was no less than 15 μC/g and less than 20 μC/g and by marking x for the result wherein the amount of charge was less than 15 μC/g. The amount of the charge under the LL environment by was evaluated by to be ranked by marking ⊚ for the result wherein the amount of charge was less than 30 μC/g, by marking O for the result wherein the amount of charge was no less than 30 μC/g and less than 40 μC/g, by marking Δ for the result wherein the amount of charge was no less than 40 μC/g and less than 50 μC/g and by marking x for the result wherein the amount of charge was no less than 50 μC/g. The results are shown in Table 2.

(Evaluation of Durability)

A two component developer was prepared by mixing a cyan toner in which the above described cyan toner particles were added with the external additives of the respective embodiments and Comparative examples, with a genuine carrier for a digital color copying machine Di3.50 (manufactured by Minolta Co., Ltd), so that the weight of the toner became 8 wt. %. Each developer of 400 g prepared in this manner was placed in a developing device of the digital copying machine Di350 (manufactured by Minolta Co., Ltd) and the continuous copying of charts having an image ratio of 6% was carried out under an environment of room temperature and normal humidity (25° C./50%) (NN environment). After the continuous copying of 10,000 sheets, the lower side of the development sleeve was once cleaned. After that, an additional 10,000 sheets were continuously copied and, then, the toner that accumulated on the lower side of the development sleeve was vacuumed up and the weight thereof was measured. The durability of the toner was evaluated to be ranked by marking ⊙ for the result wherein the amount of the accumulated smoke powder toner was less than 10 mg, by marking O for the result wherein the amount of the accumulated smoke powder toner was no less than 10 mg and less than 20 mg, by marking Δ for the result wherein the amount of the accumulated smoke powder toner was no less than 20 mg and less than 30 mg and by marking x for the result wherein the amount of the accumulated smoke powder toner was no less than 30 mg. The results are shown in Table 2.

(Evaluation of Transfer Properties)

A two component developer was prepared by mixing a cyan toner in which the above described cyan toner particles were added with the external additives of the respective embodiments and Comparative examples, with a genuine carrier for a digital color copying machine CF2001 (manufactured by Minolta Co., Ltd), so that the weight of the toner became 5 wt. %. Each developer of 400 g prepared in this manner was placed in each developing device of the digital color copying machine CF2001 (manufactured by Minolta Co., Ltd), and letter images and margin line images were outputted in secondary colors (RGB) according to a printer mode. The copied images were evaluated to be ranked by marking ⊙ for the result wherein no hollow defects occurred in the images, by marking O for the result wherein a slight number of hollow defects occurred but they could hardly be detected visually, by marking Δ for the result wherein the existence of hollow defects could be detected visually but the image was acceptable and by marking x for the result wherein hollow defects were severe and margin line images appeared as double lines. The results are shown in Table 2.

(Evaluation of Image Quality)

A developer of 400 g prepared in the same manner as in the above described "Evaluation of Transfer Properties" section was placed in each developing device in the digital color copying machine CF2001 (manufactured by Minolta Co., Ltd) and an image that was entirely a halftone image was outputted according to a printer mode. The fineness of the formed halftone image was evaluated to be ranked by marking ⊙ for the result wherein a fine uniform halftone image was reproduced, by marking O for the result wherein a slight graininess was evident using a magnifying glass though it could hardly be detected visually, by marking Δ for the result wherein graininess was evident visually but the image was acceptable and by marking x for the result wherein severe graininess was detectable visually and the image appeared to be coarse. The results are shown in Table 2.

(Evaluation of Cleaning Properties)

A developer of 400 g prepared in the same manner as in the above described "Evaluation of Image Quality" section was placed in a developing device of the digital copying machine Di350 (manufactured by Minolta Co., Ltd) and the continuous copying of a chart having an image ratio of 6% was carried out under an NN environment. Image noise in an image after continuous copying of 20,000 sheets due to cleaning (remaining contaminants due to cleaning defects, BS, filming) was checked. The evaluation was ranked by marking ⊙ for the result wherein no image noise at all resulting from cleaning was detected, by marking O for the result wherein image noise resulting from cleaning could not be detected visually but was at a level that could be detected by using a magnifying glass, by marking Δ for the result wherein image noise resulting from cleaning could detected visually but the image was at of an acceptable level and by marking x for the result wherein image noise as a result of cleaning could be detected visually and the image was of an unacceptable level. The results are shown in Table 2.

TABLE 2

| | Chargeability | | | | | | |
|---|---|---|---|---|---|---|---|
| | Change in charge as a result of | Environmental Stability | | | Transfer | Cleaning | Image |
| | stirring | LL | HH | Durability | properties | level | quality |
| Example 1 | ○ | ⊙ | ⊙ | ○ | ○ | ○ | ○ |
| Example 2 | ⊙ | ○ | ⊙ | ⊙ | ○ | ○ | ⊙ |
| Example 3 | ⊙ | ○ | ⊙ | ⊙ | ⊙ | ○ | ○ |
| Example 4 | ○ | ⊙ | ○ | ○ | ○ | ○ | ⊙ |
| Example 5 | ○ | ⊙ | ○ | ○ | ○ | ⊙ | ○ |
| Example 6 | ○ | ⊙ | ⊙ | ○ | ○ | ⊙ | ○ |
| Example 7 | ⊙ | ⊙ | ⊙ | ○ | ○ | ○ | ⊙ |
| Example 8 | ○ | ⊙ | ○ | ○ | ⊙ | ○ | ○ |
| Comparative example 1 | Δ | ⊙ | Δ | ○ | ○ | ○ | x |
| Comparative example 2 | Δ | ⊙ | Δ | ○ | x | ○ | ○ |
| Comparative example 3 | ⊙ | x | ⊙ | ⊙ | ○ | ○ | ○ |
| Comparative example 4 | x | ⊙ | x | x | ○ | ○ | ○ |
| Comparative example 5 | x | ⊙ | Δ | x | ⊙ | ○ | ○ |
| Comparative example 6 | Δ | Δ | Δ | x | ○ | x | ○ |
| Comparative example 7 | x | ⊙ | Δ | x | ⊙ | x | ○ |
| Comparative example 8 | x | ⊙ | x | x | ○ | ○ | ○ |
| Comparative example 9 | x | ⊙ | x | x | x | ○ | ○ |
| Comparative example 10 | x | ⊙ | x | x | Δ | ○ | ○ |
| Comparative example 11 | ⊙ | x | ⊙ | ○ | x | ○ | ○ |

What is claimed is:

1. A negatively chargeable toner, comprising:

toner particles prepared by means of a wet granulation method; and external additives externally added to the toner particles, wherein the external additives comprises a first hydrophobic silica having a mean primary particle size of 5 nm to 18 nm, a second hydrophobic silica having a mean primary particle size of 18 nm to 50 nm, which is greater than that of the first hydrophobic silica, and a hydrophobic titanium oxide having a mean primary particle size of 10 nm to 40 nm.

2. The toner according to claim 1, wherein said toner particles are gained by coagulating particles in a particle dispersion liquid where particles including at least resin particles are dispersed in an aqueous medium and by heating and fusing the coagulated particles.

3. The toner according to claim 1, wherein the toner particles do not include a charge control agent.

4. The toner according to claim 1, wherein inorganic fine particles having a mean primary particle size of 80 nm to 1200 nm are externally added to the negatively chargeable toner.

5. The toner according to claim 4, wherein said inorganic fine particles have a mean primary particle size of 100 nm to 800 nm.

6. The toner according to claim 4, wherein said inorganic fine particles are strontium titanate.

7. The toner according to claim 1, wherein a fatty acid metal salt is externally added to said negatively chargeable toner.

8. The toner according to claim 7, wherein the fatty acid metal salt is calcium stearate.

9. The toner according to claim 1, wherein the first hydrophobic silica has a mean primary particle size of 5 nm to 16 nm, the second hydrophobic silica has a mean primary particle size of 20 nm to 35 nm and the hydrophobic titanium oxide has a mean primary particle size of 15 nm to 30 nm.

10. The toner according to claim 1, wherein the addition amount of the first hydrophobic silica is 0.05 to 2 parts by weight, the addition amount of the second hydrophobic silica is 0.1 to 2 parts by weight and the addition amount of the hydrophobic titanium oxide is 0.1 to 2 parts by weight relative to the 100 parts by weight of toner particles.

11. A full color toner that is negatively chargeable and utilized for a full color image-forming apparatus, comprising:

toner particles prepared by means of a wet granulation method; and external additives externally added to the toner particles, wherein the external additives comprises a first hydrophobic silica having a mean primary particle size of 5 nm to 18 nm, a second hydrophobic silica having a mean primary particle size of 18 nm to 50 nm, which is greater than that of the first hydrophobic silica, and a hydrophobic titanium oxide having a mean primary particle size of 10 nm to 40 nm.

12. The toner according to claim 11, wherein said toner particles are gained by coagulating particles in a particle dispersion liquid where particles, including, at least, resin particles, are dispersed in an aqueous medium and by heating and fusing the coagulated particles.

13. The toner according to claim 11, wherein the toner particles do not include a charge control agent.

14. The toner according to claim 11, wherein inorganic fine particles having a mean primary particle size of 80 nm to 1200 nm are externally added to the negatively chargeable toner.

15. The toner according to claim 11, wherein said first hydrophobic silica has a mean primary particle size of 5 nm to 16 nm, said second hydrophobic silica has a mean primary particle size of 20 nm to 35 nm and said hydrophobic titanium oxide has a mean primary particle size of 15 nm to 30 nm.

16. The toner according to claim 11, wherein a fatty acid metal salt is externally added to said negatively chargeable toner.

17. The toner according to claim 11, in which the full color image-forming apparatus comprises the steps of:

forming a full color toner image, wherein the step of forming a toner image on an electrostatic latent image-support member and transferring this toner image from the electrostatic latent image-support member to an intermediate transfer member by means of a primary transfer roller is sequentially carried out for each of the predetermined color so that toner images of the respective colors are overlapped on the intermediate transfer member;

transferring said full color toner image on the intermediate transfer member from the intermediate transfer member to a recording medium by means of a secondary transfer roller at a portion where the intermediate transfer member is supported by a support roller; and fixing the transferred full color toner image on the recording medium.

18. The toner according to claim 11, wherein the full color image-forming apparatus comprising:

a first image formation unit for transferring a first toner image to an intermediate transfer member;

a second image formation unit for transferring a second toner image of a color differing from that of the first toner image to said intermediate transfer member;

a third image formation unit for transferring a third toner image of a color differing from those of said first and second toner images to said intermediate transfer member; and a fourth image formation unit for transferring a fourth toner image of a color differing from those of said first to third toner images to said intermediate transfer member.

19. The toner according to claim 18, wherein said first to fourth image formation units are placed beneath the intermediate transfer member.

20. A full color image-forming method, wherein the full color negatively chargeable toner according to claim 11 is utilized, comprising the steps of:

forming a full color toner image by overlapping first to fourth toner images on an intermediate transfer member through the steps of:

forming a first toner image on a first electrostatic latent image-support member and transferring this first toner image from said first electrostatic latent image-support member to the intermediate transfer member by means of a first primary transfer roller;

forming a second toner image of a color differing from that of said first toner image on a second electrostatic latent image-support member and transferring this second toner image from said second electrostatic latent image-support member to the intermediate transfer member by means of a second primary transfer roller;

forming a third toner image of a color differing from those of said first and second toner images on a third electrostatic latent image-support member and transferring this third toner image from said third electrostatic latent image-support member to the intermediate transfer member by means of a third primary transfer roller; and forming a fourth toner image of a color differing from those of said first to third toner images on a fourth electrostatic latent image-support member and transferring this fourth toner image from said fourth electrostatic latent image-support member to the intermediate transfer member by means of a fourth primary transfer roller;

transferring the full color toner image on the intermediate transfer member from the intermediate transfer member to a recording medium by means of a secondary transfer roller at a portion where the intermediate transfer member is supported by a support roller; and fixing the transferred full color toner image on the recording medium.

* * * * *